United States Patent [19]

Nakabo

[11] Patent Number: 4,543,749

[45] Date of Patent: Oct. 1, 1985

[54] MACHINE TOOL

[75] Inventor: Seiji Nakabo, Fukui, Japan

[73] Assignee: Nakabo Tekkosho Co., Ltd., Fukui, Japan

[21] Appl. No.: 528,123

[22] Filed: Aug. 31, 1983

[30] Foreign Application Priority Data

Sep. 22, 1982 [JP] Japan ..... 57-165327

[51] Int. Cl.[4] ..... B24B 3/06

[52] U.S. Cl. ..... 51/33 W; 51/288

[58] Field of Search ..... 51/33 W, 48 HE, 95 LH, 51/95 TG, 288, 95 WH

[56] References Cited

U.S. PATENT DOCUMENTS

| | | | |
|---|---|---|---|
| 918,769 | 4/1909 | Sachs | 51/33 W |
| 1,993,418 | 3/1935 | Smyser | 51/33 W |
| 2,378,302 | 6/1945 | Kline | 51/95 LH |
| 2,889,669 | 6/1959 | Babbitt | 51/95 LH |

FOREIGN PATENT DOCUMENTS

| | | | |
|---|---|---|---|
| 0814086 | 5/1959 | United Kingdom | 51/95 LH |

*Primary Examiner*—Frederick R. Schmidt
*Assistant Examiner*—Robert A. Rose
*Attorney, Agent, or Firm*—Wenderoth, Lind & Ponack

[57] ABSTRACT

A machine tool for grinding or cutting blade crests and rake faces both in the shank and in the hemispherical portion of an end mill having a hemispherical end. The movement of a work table is interlocked by a first linkage with a device for revolving a workpiece on its axis. The swiveling movement of a swivel slide is interlocked by a second linkage with the device for revolving the work.

3 Claims, 20 Drawing Figures

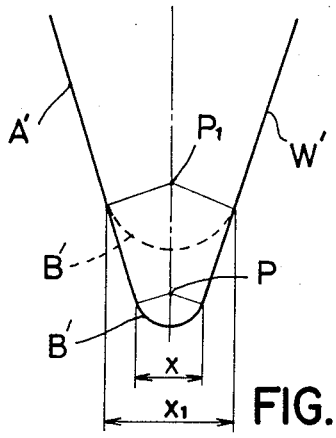
FIG.12a
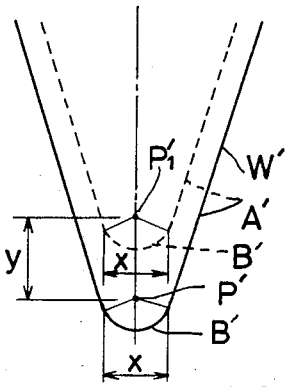
FIG.12b
FIG.13
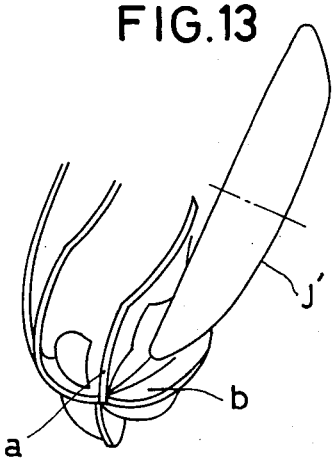
FIG.14
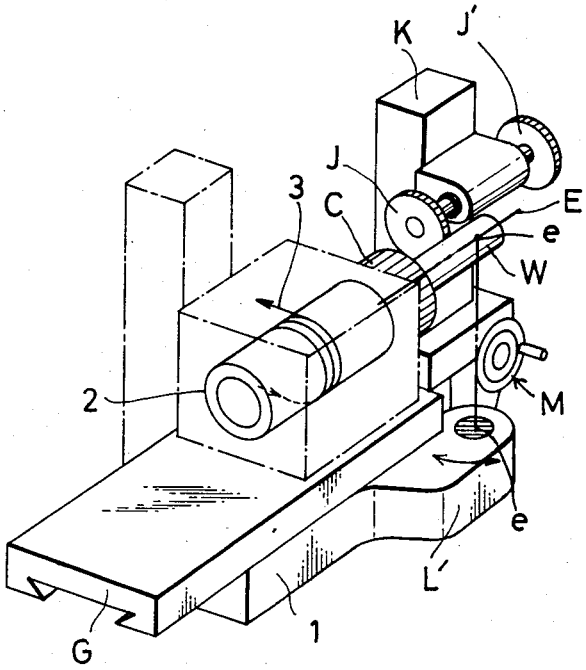
FIG.15
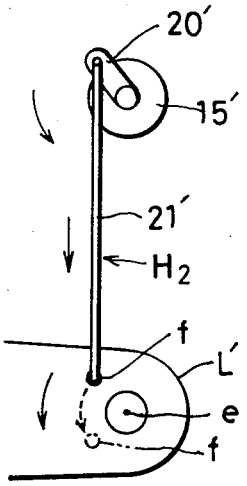

MACHINE TOOL

BACKGROUND OF THE INVENTION

The present invention relates to a machine tool for grinding or cutting blade crests and rake faces in the hemispherical portion of a bar-shaped workpiece such as an end mill having a hemispherical end.

Generally, the blades cannot always be shaped as one likes them to be when a crude material or an end mill having a square-cut end is to be made into an end mill having a hemispherical end.

In addition, many of the end mills having ordinary or hemispherical ends have spiral blades as shown in FIGS. 10 and 11 so as to have good performance in a metal-cutting operation. In case of the end mills having hemispherical ends, it has been a common practice to finish the shank A and the hemispherical portion B separately from each other, because it has been difficult to finish them by a continuous process. Especially, the following disadvantages are caused by a tooth rest which is applied to the rake faces b when the hemispherical portion B is to be ground for reuse:

1. Inflection points or undercuts are liable to be formed in the blade faces at the junction between the shank and the hemispherical portion.
2. The hemispherical portion cannot be precisely ground, because the tooth rest easily slips off the end portion of an end mill having a hemispherical end.
3. Because of the above-mentioned disadvantages, precision in grinding depends largely on the skillfulness of a worker.

SUMMARY OF THE INVENTION

It is an object of the present invention to provide a machine tool by which the blades can be shaped as one likes them to be when a crude material or an end mill having a square-cut end is to be made into an end mill having a hemispherical end.

It is another object of the present invention to provide a machine tool which does not produce inflection points or undercuts in the blade faces at the junction between the shank and the hemispherical portion.

The machine tool in accordance with the present invention comprises a workhead having a holder adapted to hold the basal part of a workpiece shaped like a bar, a device for revolving the work on its axis, a tool rest for supporting a cutting tool for grinding or cutting the work, said cutting tool being supported by a radial feed mechanism, a swivel slide for swiveling the tool rest or holder round a center which lies on the axis of the work, and line means by which the swiveling movement of the swivel slide is interlocked with the device for revolving the work. The link means include a device for adjusting the degree to which the angle of revolution of the swivel slide is converted into a constant oblique angle at which a helix is traced on the cylindrical surface of the work by the rotation thereof imparted thereto by the device for revolving the work. Thus, according to the present invention, the blades can be shaped as one likes them to be when a crude material or an end mill having a square-cut end is to be made into an end mill having a hemispherical end.

The above-mentioned link means comprise a first linkage by which the movement of a table for axially reciprocating the work is interlocked with the device for revolving the work and a second linkage by which the swiveling movement of the swivel slide is interlocked with the device for revolving the work. Thus, according to the present invention, the twisted blades in the shank A and the hemispherical portion B of an end mill having a hemispherical end can be smoothly ground by a continuous process, free from the formation of inflection or undercut at the junction between the shank and the hemispherical portion.

With the above-described objects in view and as will become apparent from the following detailed description, the present invention will be more clearly understood in connection with the accompanying drawings.

BRIEF DESCRIPTION OF THE DRAWINGS

FIGS. 12*a*–12*b* are side views of a tapered end mill having a hemispherical end;

FIG. 13 is a perspective view, illustrating the rake faces being ground with a machine tool in accordance with the present invention;

FIG. 14 is a perspective view of another embodiment of the present invention; and FIG. 15 is a plan view of the second linkage thereof.

DETAILED DESCRIPTION OF THE INVENTION

Figure 1:
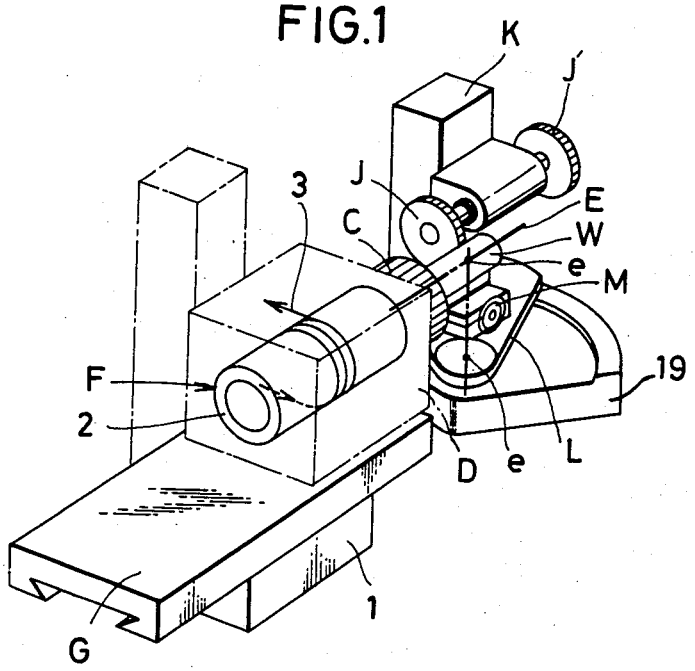
FIG. 1 is a perspective view of the tool rest of the invention and the device for revolving the work on its axis.

Embodiments of the present invention will be hereinafter described in connection with the accompanying drawings. In FIGS. 1 to 13, especially in FIGS. 1 and 2, the machine tool in accordance with the present invention includes a workhead D having a holder C adapted to hold the basal part of a workpiece W shaped like a bar, a device F for revolving the workpiece W on its axis E, a table G for axially reciprocating the workpiece W, a first linkage H1 by which the movement of the table G is interlocked with the device F, a tool rest K for supporting a cutting tool J for grinding or cutting the workpiece W, said cutting tool being supported by a radial feed mechanism M, a swivel slide L for swiveling the tool rest K round a center e which lies on the axis of the workpiece W, and a second linkage H2 by which the swiveling movement of the swivel slide L is interlocked with the device F.

In the drawings, the workpiece W is a material for an end mill having a hemispherical end. The workhead D is mounted on the table G and is movable on a saddle 1 by means of a feed screw (not shown) which is hand-operated or motor-driven. The table G moves in the direction which is parallel with the axis of the workpiece W. A wire 3, which is one of the components of the device F, is wound around a work spindle 2 coupled to the holder C and supported in the workhead D. The wire 3 is tightened so as not to slip on the surface of the work spindle 2.

Figure 3:
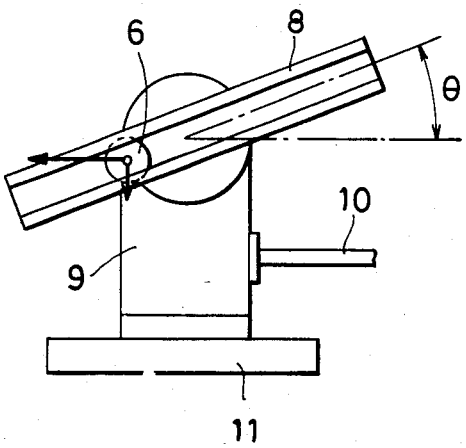
FIGS. 3 and 4 are front views of part of the first linkage.

The first linkage H1 is constructed as follows. Both end portions of the wire 3 pass over the rims of a pair of upper pulleys 4 and 5 and a pair of lower pulleys 4 and 5, respectively, which are supported by the workhead D, and both ends of the wire 3 are secured to a wire support 7 connected to a first roller 6. The roller 6 fits in a grooved guide 8 and is adapted to move along the groove. As shown in FIG. 3, the guide 8 is mounted on a cradle 9 in such a manner that the angle $\theta$ is adjustable. When the table G is longitudinally moved with the guide 8 held on the tilt, the workpiece W axially moves while revolving on its axis, because revolving motion is imparted to the work spindle 2 by the roller 6 and the wire 3. Thus the movement of the workpiece W is adapted for spiral grinding.

Figure 9A:
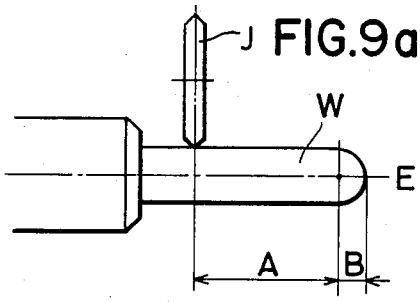
FIGS. 9*a*–9*b* are plan views, illustrating the operation of the invention.
Figure 9B:
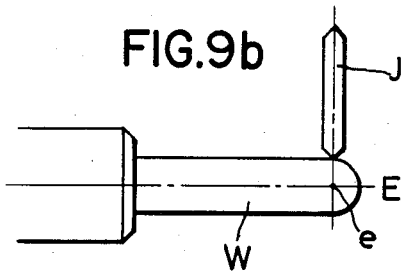
Figure 9C:
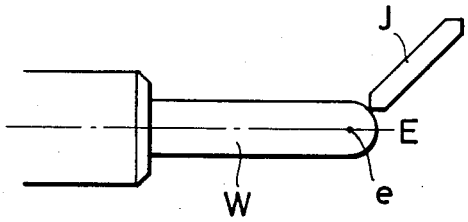
Figure 9D:
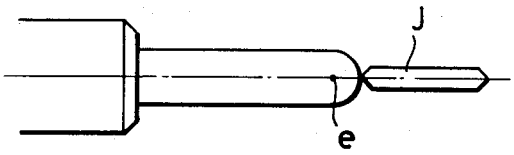
Figure 10:
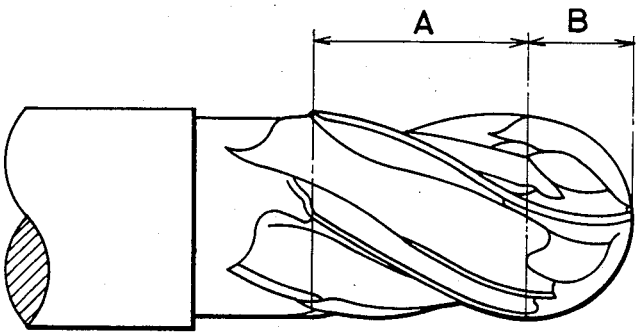
FIG. 10 is a side view of the end mill having a hemispherical end.
Figure 11:
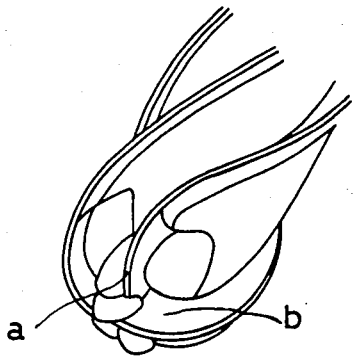
FIG. 11 is a perspective view thereof.

Let it be supposed that the blade crests a (FIG. 11) of an end mill having a hemispherical end are going to be ground. For the purpose of grinding the region of the shank A in FIG. 10, the workpiece W is moved leftwardly as shown in FIG. 9*a* and the spirally shaped peripheral surface of the shank A is ground. For the purpose of grinding the hemispherical portion B when the shank A has been ground with the grinding wheel J, the table G is stopped when the grinding wheel J comes to the junction between the shank A and the hemispherical portion B as shown in FIG. 9*b*. During this grinding process, the roller 6 moves from right to left along the groove in the guide 8 in FIG. 3 and stops when the table G is stopped.

Figure 4:
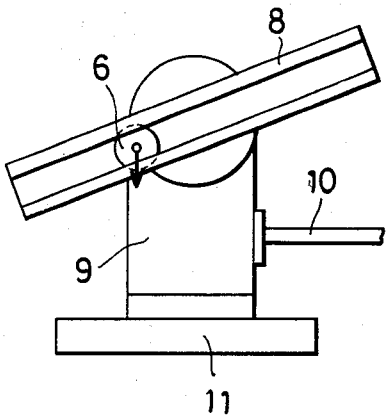
Figure 5:
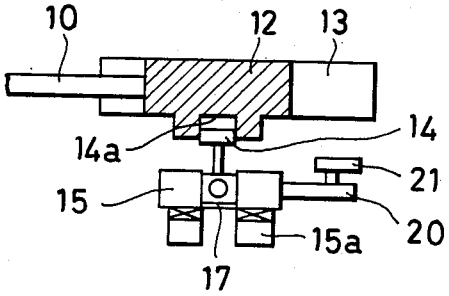
FIG. 5 is a front view of a part of the second linkage.
Figure 6:
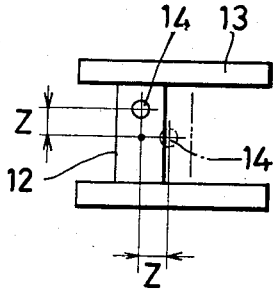
FIG. 6 is a plan view thereof.
Figure 7:
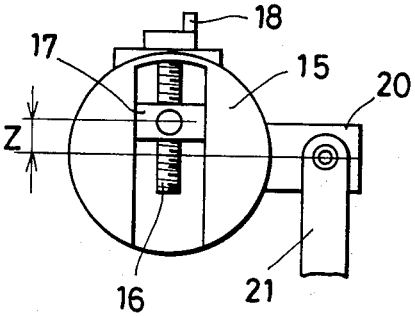
FIGS. 7 and 8*a* are plan views of the revolving member of the second linkage.
Figure 8A:
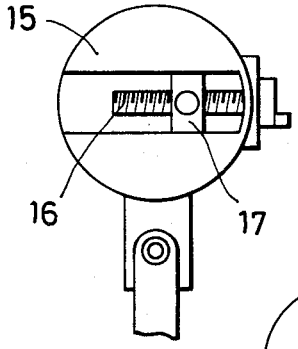

The second motion motion H2 is constructed so as to work as follows. When a connection rod 10 pulls the cradle 9 rightwardly along a saddle 11, the height of the roller 6 relative to the saddle 11 begins to be reduced as shown in FIG. 4. Consequently the workpiece W begins to revolve on its axis E while it is prevented from leftward movement. The revolving motion takes place in the same direction as that which takes place when the workpiece W is moved leftwardly. The connecting rod 10, which causes the guide 8 and the cradle 9 to move rightwardly along the saddle 11, is connected to a slider 12 in FIG. 2. As shown in FIGS. 5 and 6, the slider 12 is flanked on both sides by slide guides 13 so as to slide therealong in the same direction as the table G. The slider 12 is provided with a guide groove 14*a* extending perpendicularly to the direction in which the slider 12 moves. A second roller 14 rotatably fits in the guide groove 14*a* and is adapted to move therealong. The roller 14 is supported by a nut 17 accommodated in a revolving member 15 adapted to revolve on its stationary axis. The internal threads of the nut 17 receive an adjusting screw 16 for adjusting the helical angle of the blade crests. The axis of the adjusting screw 16 runs parallel with the guide groove 14*a* in the slider 12. As shown in FIGS. 7 and 8, the distance Z between the center of the revolving member 15 and that of the nut 17 can be adjusted by manipulating a handle 18. Thus a device for adjusting the degree to which the angle of revolution of the swivel slide L is converted into the twist of the device F is constructed by the adjusting screw 16, nut 17 and handle 18.

Figure 8B:
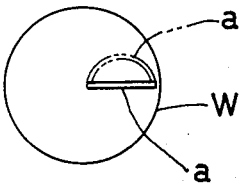
FIG. 8*b* is a front view of an end mill having a hemispherical end.

In ordinary cases, the distance Z is adjusted to the radius of the end of the work W. The twist $\theta$ of the blade crests in the hemispherical portion B can be changed by changing the distance Z as long as the angle $\theta$ of the guide 8 (FIG. 3) of the first linkage H1 assumes a value other than zero. This holds good irrespective as of whether the swiveling movement of the swivel slide is interlocked with, or independent of, the operation of the device for revolving the workpiece W at the time of grinding the hemispherical portion B. For example, when the distance Z is reduced to zero, the workpiece W does not revolve on its axis because the guide 8 of the first linkage H1 is not pulled by the connecting rod 10. Consequently the twisted formation of blades does not take place in the hemispherical portion B. In other words, the twist of the blade crests in the hemispherical portion B is reduced to zero as shown in FIG. 8*b*, and the blade crest a as viewed from the front is in the shape of a straight line. In proportion to the increase of the distance Z, the twist increases as shown with dotted lines in FIG. 8*b*. Thus the blades can be shaped at any twist when a crude material or an end mill having a square-cut end is made into an end mill having a hemispherical end.

Figure 2:
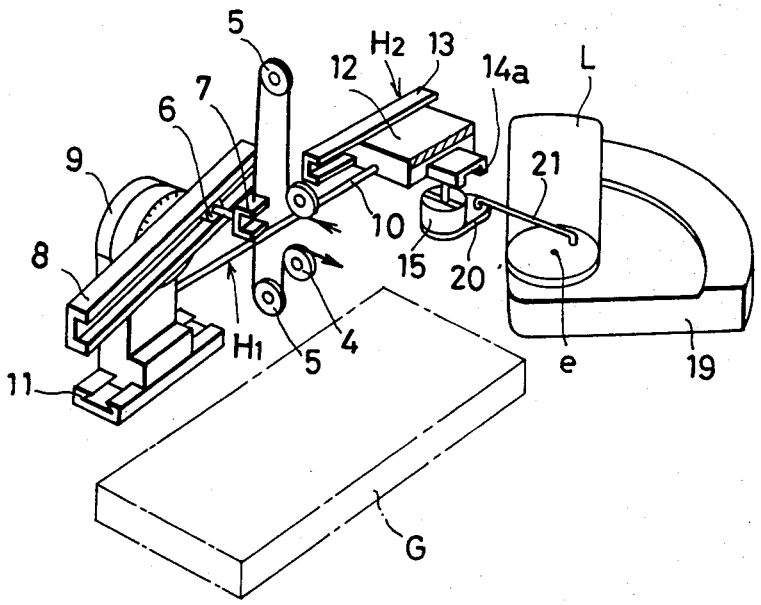
FIG. 2 is a perspective view of the first and second linkages.

As shown in FIGS. 1 and 2, the swivel slide L is of a hand-operated or motor-driven type adapted to swivel around the center e along a segment saddle 19. The swivel slide L is connected to an arm 20 of the revolving member 15 by an eccentic rod 21. When the swivel slide L is swiveled, by means of this second linkage H2, the eccentic rod 21, the revolving member 15 mounted on a support 15*a* (FIG. 5), the nut 17, the second roller 14, the slider 12, the connecting rod 10 and the guide 8 move rightwardly and thereby the first roller 6 is pushed downwardly. Consequently the work spindle 2 is revolved on its axis.

During the grinding process, the positions of the workpiece W for an end mill having a hemispherical end relative to the positions of the rotary cutting tool J are as shown in FIG. 9. The center e around which the cutting tool J is swiveled is cause to agree with the center of curvature of the hemispherical end of the workpiece W. At the start of the grinding sequence, the parts are in a position as seen in FIG. 9*a*. The workpiece W axially moves while revolving motion is imparted thereto by the inclined guide 8 disposed on the left (not shown), so that a twist is made by the resultant motion. Then the cutting tool J comes to the junction between the shank A and the hemispherical portion B of the work as shown in FIG. 9*b*, the leftward movement of the work W is suspended and the cutting tool J begins to swivel round the center e with the radius of Z along the surface of the hemispherical portion. In the middle of grinding the hemispherical portion, the cutting tool J is in a position as seen in FIG. 9*c*. As aforesaid, the guide 8 moves rightwardly while the grinding sequence proceeds from FIG. 9*b* to FIG. 9*d*. In FIG. 9*d*, the axis of the cutting tool J is perpendicular to the axis E of the workpiece W, where the grinding of the hemispherical portion B is completed.

During the grinding of the hemispherical portion, the guide 8 moves rightwardly in FIG. 4 by the distance equal to the radius of the workpiece W. The first roller 6 is thereby pushed downwardly so as to rotate the movement of the workpiece W for spiral grinding. Thus a twist required for grinding the hemispherical portion of the workpiece W is given.

Although in FIGS. 1 and 2 the work spindle 2 is revolved on its axis by means of the wire 3 which is pulled by the first roller 6 sliding along the guide 8, it goes without saying that these may be replaced by a rack and pinion.

As shown in FIG. 13, rake faces b can also be ground in the same manner as the blade crests a, for which purpose a grinding wheel J' is placed against a rake face b and put in the same motion as aforesaid. By setting the guide 8 at the same condition as when the blade crests a are ground, the blade crests and the rake faces can be smoothly streamlined in the same manner, free from care about the formation of undercut or inflection in the blade faces.

What is called a tapered end mill having a hemispherical end, such as designated by the letter W' in FIGS. 12*a* and 12*b*, which is shaped by the taper given to a metal mold so that an end mill shaped therein can be easily withdrawn from the mold, is in general use. When such an end mill is mounted on a machining center or a numerically controlled milling machine, the program will have to be modified every time such an end mill is ground for reuse, if the shank A' thereof fails to be ground and only the hemispherical portion B' is ground. For example, P in FIG. 12*a* designates the center of curvature of the hemispherical end of a new tapered end mill, which shifts to P1 if only the hemispherical end is ground. The expansion of the dimension from X to X1 causes a difference in the position of the hemispherical end relative to the position of a workpiece, and this difference makes the program unusable.

On the contrary, the dimension X remains unchanged if both the shank A' and the hemispherical portion B'are ground by means of a machine tool in accordance with the present invention to such an extent that the center P' shifts to P1' as shown in FIG. 12*b*. Because the figure obtained after the grinding is similar to the initial figure, the program has only to be revised in terms of the dimension y. As a matter of course, the present invention makes it possible to grind only the hemispherical portion.

Referring now to FIGS. 14 and 15 showing another embodiment of the present invention, this is an instance where the holder C is swiveled by a swivel slide L' around the center e which lies on the axis of the workpiece W. The swivel slide L' is secured to the saddle 1, which is of a hand-operated or motor-driven type adapted to swivel round a center e. The point f, which is in a position deviating from the center e, is connected to an arm 20' of a revolving member 15' by a rod 21', which altogether constitute the second linkage H2. In other components and the functions of, this embodiment are similar to the above-described first embodiment.

What I claim is:

1. A machine tool comprising a workpiece supporting spindle rotatable about its own axis, a wire wound around said workpiece supporting spindle, a wire support to which the opposite ends of said wire are secured, a roller mounted on said wire support, a guide having a longitudinal groove along which said roller is movable, a cradle on which said guide is mounted for continuous rotation to a desired angle, said cradle being slidable parallel to said spindle axis, a tool rest for supporting a tool for grinding a workpiece, a swivel slide on which said tool rest is mounted, said swivel slide being pivotable around a pivot axis which extends through the axis of said workpiece supporting spindle, and a linkage connecting said swivel slide and said cradle and translating the swivelling movement of said swivel slide to straight-line sliding motion of said cradle in the direction parallel to the axis of said workpiece supporting spindle.

2. A machine tool as claimed in claim 1 in which said linkage includes means for continuously smoothly varying the degree of rotation of said swivel slide translated into the straight-line sliding motion.

3. A machine tool as claimed in claim 2 in which said means comprises a revolving member having an arm thereon linked eccentrically to said swivel slide, and adjusting member movable diametrically of said revolving member and to which the remainder of said linkage to said cradle is connected, and adjusting means connected to said adjusting member for continuously smoothly adjusting the diametrical position of said adjusting member.

* * * * *